US005653827A

United States Patent [19]

Kramer et al.

[11] Patent Number: 5,653,827

[45] Date of Patent: Aug. 5, 1997

[54] BRASS ALLOYS

[75] Inventors: Keith D. Kramer, Racine; Thomas R. Hoesly, Oconomowoc; Frederick F. Treul, Milwaukee, all of Wis.

[73] Assignee: Starline Mfg. Co., Inc., Milwaukee, Wis.

[21] Appl. No.: 471,006

[22] Filed: Jun. 6, 1995

[51] Int. Cl.[6] ..... C22C 9/02

[52] U.S. Cl. ..... 148/433; 148/434; 420/471; 420/472; 420/473; 420/474; 420/475; 420/476; 420/479

[58] Field of Search ..... 148/433, 434; 420/473, 471, 472, 479, 474, 475, 476

[56] References Cited

U.S. PATENT DOCUMENTS

| | | | |
|---|---|---|---|
| 1,149,850 | 8/1915 | Metzger | 420/587 |
| 1,921,417 | 8/1933 | Leach | 420/483 |
| 1,959,509 | 5/1934 | Tour | 420/481 |
| 2,026,209 | 12/1935 | Brace | 420/497 |
| 2,073,371 | 7/1937 | Hensel | 420/497 |
| 2,188,681 | 1/1940 | Freeman et al. | 420/483 |
| 2,246,328 | 6/1941 | Smith | 148/33 |
| 2,330,062 | 9/1943 | Lempert | 420/497 |
| 2,581,903 | 10/1952 | Bailey et al. | 546/35 |
| 2,975,255 | 3/1961 | Lafferty | 218/132 |
| 3,246,979 | 4/1966 | Lafferty | 420/491 |
| 3,370,942 | 2/1968 | Inoue | 420/89 |
| 3,395,986 | 8/1968 | Gruber | 423/289 |
| 3,437,479 | 4/1969 | Nakajima | 420/457 |
| 3,502,465 | 3/1970 | Nakajima | 420/496 |
| 3,551,214 | 12/1970 | Ford et al. | 428/469 |
| 3,725,052 | 4/1973 | Masumoto et al. | 420/434 |
| 3,770,497 | 11/1973 | Hässler et al. | 427/191 |
| 3,805,000 | 4/1974 | Roy | 218/130 |
| 4,009,027 | 2/1977 | Naidich et al. | 420/473 |
| 4,091,248 | 5/1978 | Arakawa et al. | 218/132 |
| 4,180,398 | 12/1979 | Parikh | 420/484 |
| 4,198,232 | 4/1980 | Parr et al. | 148/437 |
| 4,231,814 | 11/1980 | Watanabe et al. | 148/95 |
| 4,464,213 | 8/1984 | Nielsen | 148/442 |
| 4,499,009 | 2/1985 | Yamanaka et al. | 252/512 |
| 4,511,410 | 4/1985 | Shapiro et al. | 148/522 |
| 4,517,033 | 5/1985 | Okumura et al. | 148/432 |
| 4,537,743 | 8/1985 | Yamanaka et al. | 419/38 |
| 4,551,395 | 11/1985 | Lloyd | 428/677 |
| 4,586,967 | 5/1986 | Shapiro et al. | 148/412 |
| 4,677,264 | 6/1987 | Okumura et al. | 218/130 |
| 4,678,720 | 7/1987 | Hsu et al. | 428/606 |
| 4,708,739 | 11/1987 | Kellie et al. | 75/304 |
| 4,733,018 | 3/1988 | Prabhu et al. | 174/257 |
| 4,786,469 | 11/1988 | Weber et al. | 420/469 |
| 4,853,184 | 8/1989 | Naya et al. | 420/489 |
| 4,865,805 | 9/1989 | Holowaty | 420/85 |
| 4,879,094 | 11/1989 | Rushton | 420/476 |
| 5,000,779 | 3/1991 | German et al. | 75/244 |
| 5,017,250 | 5/1991 | Ashok | 148/411 |
| 5,039,478 | 8/1991 | Sankaranarayanan | 420/469 |
| 5,098,487 | 3/1992 | Brauer et al. | 148/432 |
| 5,102,748 | 4/1992 | Wylam et al. | 428/647 |
| 5,137,685 | 8/1992 | McDevitt et al. | 420/477 |
| 5,147,469 | 9/1992 | Kanzaki et al. | 148/684 |
| 5,167,726 | 12/1992 | LoIacono et al. | 148/432 |
| 5,174,469 | 12/1992 | Policapelli | 220/710 |
| 5,198,154 | 3/1993 | Yokoyama et al. | 252/514 |
| 5,288,458 | 2/1994 | McDevitt et al. | 420/477 |
| 5,330,712 | 7/1994 | Singh | 420/473 |
| 5,360,591 | 11/1994 | Ruetz et al. | 420/479 |

FOREIGN PATENT DOCUMENTS

| | | |
|---|---|---|
| 84593 | 11/1953 | Czechoslovakia . |
| 0889984 | 9/1953 | Germany . |
| 2159482 | 12/1973 | Germany . |
| 45-27216 | 9/1970 | Japan . |
| 50-003975 | 2/1975 | Japan . |
| 54-135618 | 10/1979 | Japan . |
| 57-073149 | 5/1982 | Japan . |
| 57-073150 | 5/1982 | Japan . |
| 59-050143 | 3/1984 | Japan . |
| 61-133557 | 6/1986 | Japan . |
| 4-236734 | 8/1992 | Japan . |
| 467126 | 12/1972 | U.S.S.R. . |
| 1157636 | 7/1969 | United Kingdom . |
| 1157652 | 7/1969 | United Kingdom . |

OTHER PUBLICATIONS

H.C.H. Carpenter, "The Critical Point at 470° C. In Copper–Zinc Alloys", The University, Manchester, pp. 70–104. (1912).

D.W. Davies, "Bismuth In Copper and Copper Base Alloys: A Literature Review", Copper Development Assoc., Inc., Aug. 1993.

CA958):66285q. Distribution of lead and bismuth in the structure of cast copper and copper alloys. Pikunov et al., (Mosk. Ins. STali Splavov, Moscow, USSR). Izv. Vyssh. Uchebn. Zaved., Tsvetn. Metall. (2), 80–4 (Russ) 1981. Coden: Ivutak. ISSN: 0021–3438.

S.2637, 101st Congress, 2d Session, A Bill, May 16 (legislative day, Apr. 18), 1990, Mr. Reid et al., pp. 1–35.

(List continued on next page.)

*Primary Examiner*—Sikyin Ip

*Attorney, Agent, or Firm*—Leydig, Voit & Mayer, LTD.

[57] ABSTRACT

Reduced-lead yellow brass alloys are disclosed. The alloys comprise copper; zinc; an amount of bismuth effective to enhance castability of the alloys; and an amount of selenium effective to increase machinability of the alloy. Preferably, the alloys further include an amount of antimony effective to inhibit dezincification of the alloys. In a particularly preferred embodiment, an alloy according to the present invention comprises zinc; copper in an amount ranging from about 62.5% to about 64.0% by weight; tin in an amount ranging from about 0.2% to about 0.4% by weight; iron in an amount ranging from about 0.1% to about 0.3% by weight; nickel in an amount ranging from about 0.15% to about 0.25% by weight; aluminum in an amount ranging from about 0.3% to about 0.6% by weight; bismuth in an amount ranging from about 0.8% to about 1.0% by weight; antimony in an amount ranging from about 0.02% to about 0.04% by weight; and selenium in an amount ranging from about 0.05% to about 0.25% by weight. The disclosed alloys exhibit excellent castability, machinability, and polishability, and, when used in decorative plumbing fixtures, will not dezincify nor leach lead into potable water.

10 Claims, No Drawings

OTHER PUBLICATIONS

Angino et al., "Drinking Water Quality and Chronic Disease," *Environmental Science & Technology,* vol. 11, No. 7, (Jul. 1977) pp. 661–665.
Audy, J. et al., "Composition and Microstructure of Medieval Bells," *Prakt. Metallogr,* 29 (2), (1992) pp. 74–85.
Bishop, "Lead–Free Copper Alloys For Plumbing Developed by AT&T's Bell Laboratories," The Wall Street Journal, (May 15, 1991).
Blazey, Clement, "Brittleness in Copper," *The Journal of the Institute of Metals,* vol. XLVI, (1931) pp. 353–383.
CA Selects: Bismuth Chemistry, Issue 20, (1992) p. 1.
Carpenter, "The Effect of Other Metals on the Structure of the beta Constituent in Copper–Zinc Alloys," *The Journal of the Institute of Metals,* vol. VIII, No. 2, (1912) pp. 59–85.
Chemical Abstracts 106: 37311c, vol. 106, (1987) p. 270.
Chemical Abstracts 91: 95313v, vol. 91, (1979) p. 95317.
Cibula, A., "Grain–Refining Additions for Cast Copper Alloys," *The Journal of the Institute of Metals,* vol. 82, (Jan. 21, 1954) pp. 513–524.
Cibula, A., "Influence of Grain Size on the Structure, Pressure–tightness and Tensile Properties of Sand–cast Bronzes and Gunmetals," *The British Non–Ferrous Metals Research Association,* Paper No. 1211, pp. A73–A90.
Copper Development Association, "Alloy Data—Part 2," *Standards Handbook,* (1985).
"Corrosion of Metals and Alloy—Determination of Dezincification Resistance of Brass," *International Organization for Standardization ISO 6509,* First Edition—(1981) 07–01.
Dennison, J.P., "The Application of Grain Refinement to Cast Coper–Aluminum Alloys Containing the Beta Phase," *The Journal of the Institute of Metals,* vol. 81, (Dec. 12, 1952) pp. 513–520.
Dennison, J.P., "The Refinement of Cast Grain–Size in Copper–Aluminum Alloys Containing 7–9 Per Cent. Aluminum," *The Journal of the Institute of Metals,* vol. 85, (Feb. 20, 1956) pp. 8–10.
Dresher, W.H., "Lead–free and reduced–lead copper–base cast plumbing alloys," *Metall,* 47 Jahrgang, Heft 1, (Jan. 1993) pp. 26–33.
Carpenter, "Further Experiments on the Critical Point at 470°. In Copper–Zinc Alloys, " Read at Annual General Meeting, London, Jan. 17, 1912.
Eborall, "Some Observations of the Mode of Occurrence of Selenium, Tellurium and Bismuth in Copper," *The Journal of the Institute of Metals,* vol. LXX, (1944) pp. 435–446.
Feder, "A New Form of Brass, to Cut Lead in Drinking Water," *The New York Times,* (May 15, 1991), p. D7.
Flemings, M.C., "Solidification Processing," *McGraw–Hill, Inc.,* (1974) pp. 252–258.
Foundry, "Technical Developments," *Management & Technology,* (Oct. 1993) p. 20.
Gordon et al., "Bismuth Bronze From Machu Picchu, Peru," *Science,* vol. 223, (Feb. 10, 1984) p. 585.
Jackson et al., "A Preliminary Assessment of the Value of Minor Alloy Additions in Counteracting the Harmful Effect of Impurities on the Hot Workability of Some Copper Alloys," *The Journal of the Institute of Metals,* vol 98, (1970) pp. 193–198.
News Release—"New Family of Lead–Free Red Brass Cast Alloys Announced," *Copper Development Association, Inc.,* (Aug. 2, 1994) pp. 1–6.
Northcott, L., "The Influence of Alloying Elements on the Crystalization of Copper. Part II–Large Additions and the Part Played by the Constitution," *The Journal of the Institute of Metals,* vol. LXV, (Nov. 22, 1938) pp. 173–204.
Northcott, L., "The Influence of Alloying Elements on the Crystallization of Copper. Part I–Small Additions and the Effect of Atomic Structure," *The Journal of the Institute of Metals,* vol. LXII, (Oct. 01, 1937) pp. 101–136.
Ojebuoboh, F.K., "Bismuth–Production, Properties, and Applications," *JOM,* (Apr. 1992) pp. 46–49.
Oya et al., Rept. Casting Res. Lab, Waseda University, No. 30, 1979, p. 93–100.
Plewes, J.T. et al., "Free–Cutting Copper Alloys Contain No Lead," *Advanced Materials and Processes,* (Oct. 1991) pp. 23–27.
Plewes et al., "Bismuth as an Additive in Free–Machining Brasses," *Modern Casting,* (Feb. 1993) pp. 32–33.
Press Release, *Copper Development Association.* USP 1149850 Aug. 10, 1915.
Price et al., "Bismuth–Its Effect on the Hot–Working and Cold–Working Properties of Alpha and Alpha–Beta Brasses," *Transactions of A.I.M.E.,* (1942) pp. 136–143.
Samuels, "The Metallography of Copper Containing Small Amounts of Bismuth," *The Journal of the Institute of Metals,* vol. LXXVII, (1949–1950) pp. 91–102.
Schofield et al., "The Microstructure of Wrought Non–Arsenical Phosphorous–Deoxidized Copper Containing Small Quantities of Bismuth," *The Journal of the Institute of Metals,* vol. LXXIII, (1947) pp. 377–384.
Smith, "Grains, Phases, and Interfaces: An Interpretation of Micro–Structure," *Transactions of A.I.M.E.,* (1984) pp. 15–51.
Subramanian et al., "Lead Contamination of Drinking Water," *Journal of Environmental Health,* (Sep./Oct. 1991) pp. 29–32.
Voce et al., "The Mechanism of the Embrittlement of Deoxidized Copper by Bismuth," *The Journal of the Institute of Metals,* vol. LXXIII, (1947) pp. 323–376.
Waterhouse, "The Embrittlement of Alpha–Brasses by Liquid Metals," *The Journal of the Institute of Metals,* vol. 91, (1963) pp. 216–219.

BRASS ALLOYS

TECHNICAL FIELD OF THE INVENTION

The present invention pertains to brass alloys. Specifically, the present invention pertains to machinable, castable, reduced-lead yellow brass alloys that readily may be cast to form decorative products such as plumbing components for delivering potable water.

BACKGROUND OF THE INVENTION

Copper and its alloys have been metallurgical staples for centuries. In particular, brass, some forms of which include an alloy of copper with zinc, is widely used in a number of commercial and consumer applications. Brass is particularly useful for use in plumbing fixtures for potable water systems. Red brass, which comprises zinc, lead, tin, and copper, copper being present in an amount in the range of about 75% to about 95% by weight, may be used in plumbing fixtures. However, yellow brass, because of certain desirable properties, is more commonly used in plumbing fixtures. Yellow brass typically comprises copper and zinc in a ratio of approximately 60% copper to zinc, i.e., a ratio of about 1.5:1.

The essential ingredients in yellow brass are copper and zinc. Other components typically are added to brass alloys to influence their properties. For example, lead has for years been added to brass alloys to enhance, for example, the machinability of the alloys. Machinability may be defined as the ease of cutting of an alloy relative to a standard alloy. "Cutting" may mean turning, shaping, planing, drilling, reaming, tapping, milling, sawing, broaching, or similar operations. See *Engineering Metals And Their Alloys*, ch. X, p. 472 (1949). In the case of yellow brass, the standard alloy is CDA-360, which has been assigned an arbitrary machinability of 100. Generally speaking, although somewhat dependant on its use, any alloy having machinability of about 75 or more is said to exhibit acceptable machinability.

Another desired property of yellow brass is castability. Castability of an alloy refers to the tendency of the alloy to resist hot tearing, gross shrinkage, intermetallic compound formation and inclusion formation upon casting of the brass in a mold. Castability often is difficult to attain in brass alloys. When an alloy exhibits poor castability, it is commercially impractical to cast the alloy to form plumbing fixtures or other products. The type of casting process also is pertinent to the castability of the alloy; for example, red brass typically cannot be cast in a permanent mold casting process.

Another desired property of a yellow brass alloy is resistance to dezincification. When brass comes into contact with water, the zinc may leach out of the brass, leaving a copper matrix. This copper matrix is brittle, has poor mechanical properties, and suffers in appearance. This can be a particularly serious problem when the alloy is used in decorative products, such as plumbing fixtures.

Polishability is another desired feature of yellow brasses. Preferably, the brass metal, after casting, should exhibit a flawless, nonporous surface, with no hard spot inclusions. After casting, brass typically first is polished with sand paper or an abrasive belt, then is buffed with a buffing compound and wheel to produce a smooth, mirror-like surface on the brass. Porosity or hard spot inclusions detrimentally affect the polishing process, as well as subsequent processes such as plating or clear-coating. Such defects detract from the appearance of a brass decorative product.

Yellow brasses that are easily castable, readily machinable, and resistant to dezincification are known. Most such brasses include lead, an additive which is used to improve both the castability and the machinability of brass. Recently, however, the use of lead in yellow brass alloys has fallen into disfavor. Lead has been identified as posing significant health concerns, and it has been discovered that lead may leach out of the alloy when the brass is used in a plumbing fixture.

Accordingly, brass makers have striven for several years to produce yellow brass alloys that do not contain lead. The first attempts at making a lead-free yellow brass alloy resulted in alloys that were essentially non-castable and poorly machinable. Thus, various other additives have been added in lieu of lead in attempting to enhance the machinability of the brass; for example, bismuth.

Although bismuth is known to enhance the machinability of brass, bismuth is generally regarded as unacceptable in yellow brass alloys. Bismuth is known to greatly increase the brittleness of brass, when used even in very small amounts. See *ASM Metals Handbook*, pages 907–916 (1948) (discussing the brittleness problem). In addition, bismuth is costly and generally has proven to be less satisfactory than hoped in enhancing the machinability of yellow brass in a castable alloy. For these reasons, the prior art has not been able to effect a satisfactory substitution of bismuth for lead.

Thus, notwithstanding the efforts of those skilled in the art, there exists a need for an effective reduced-lead yellow brass alloy that is readily machinable, castable, and polishable, and that resists dezincification. It is a general object of the present invention to overcome the shortfalls inherent in previously known brass alloys. Specifically, it is a general object of the present invention to provide a reduced-lead yellow brass alloy that exhibits satisfactory castability, machinability, and polishability. It is further a general object of the present invention to provide a non-brittle yellow brass alloy that includes bismuth. It is further an object of the present invention to provide a yellow brass alloy that exhibits minimal dezincification when subjected to water. Further, it is an object of the present invention to provide a yellow brass alloy that has an excellent color and appearance.

SUMMARY OF THE INVENTION

The present invention overcomes the shortfalls associated with prior art alloys by providing reduced-lead yellow brass alloys comprising copper; zinc; an amount of bismuth effective to enhance castability of the brass alloys; and an amount of selenium effective to increase machinability of the brass alloys. The alloys of the present invention are yellow brass alloys. Preferably, the alloys include an amount of antimony effective to inhibit dezincification of the alloys. In one form, the invention is based upon the unexpected discovery that the addition of both bismuth and selenium to brass, using surprisingly low levels of bismuth and selenium, results in a castable, machinable brass alloy that may be prepared without lead.

In a particularly preferred embodiment, a brass alloy according to the present invention consists essentially of zinc, copper in an amount ranging from about 63.25% to about 63.75% by weight; tin in an amount ranging from about 0.2% to about 0.4% by weight; iron in an amount ranging from about 0.1% to about 0.3% by weight; nickel in an amount ranging from about 0.15% to about 0.25% by weight; aluminum in an amount ranging from about 0.35% to about 0.45% by weight; bismuth in an amount ranging from about 0.85% to about 0.95% by weight; antimony in an amount ranging from about 0.02% to about 0.04% by weight; and selenium in an amount ranging from about 0.10% to about 0.15% by weight. Boron preferably is included as a grain refiner in the alloys of the present invention.

DESCRIPTION OF THE PREFERRED EMBODIMENTS

The brass alloys of the present invention comprise copper and zinc. Specifically, the brass alloys of the present invention are yellow brass alloys, that is, alloys in which the copper-to-zinc ratio is approximately 1.5:1. In the brasses of the preferred embodiment of the present invention, copper preferably is present in an amount ranging from about 62.5% to about 64.0% by weight. Outside of this range, shrinkage in the alloys while casting sometimes is observed, and it is sometimes observed that the alloys crack or hot tear upon casting. Most preferably, copper is present in the alloys of the present invention in an amount ranging from about 63.25% to about 63.75% by weight. Larger amounts of copper help to reduce the dezincification of yellow brass alloys by maximizing the ratio of $\alpha$ to $\beta$ phase of the brass. Because the $\beta$ phase is the phase that dezincifies, reducing the amount of this phase helps inhibit dezincification.

Zinc further is an element of the brass alloys of the present invention. The amount of zinc present preferably is dependent upon the amount of other components of the alloy. Preferably, zinc is present in an amount ranging from about 33% to about 35% by weight.

The alloys of the present invention further include bismuth. Surprisingly, bismuth has been found to enhance the castability of the brass alloys of the present invention, when used in an amount ranging from about 0.8% to about 1.0% by weight. When bismuth is used in amounts greater than about 1.0% by weight, it is believed to adversely affect the fluidity and the machinability of the alloys. Preferably, bismuth is used in the alloys of the present invention in an amount ranging from about 0.85% to about 0.95% by weight.

The brass alloys of the present invention further include selenium. Selenium is present in the alloys of the present invention in an amount ranging from about 0.05% to about 0.25% by weight; preferably, from about 0.10% to about 0.15% by weight. Selenium improves the machinability of the brass alloys of the present invention. Surprisingly, it has been found that selenium is effective in improving machinability even in such small amounts as those used in the present invention.

It is only necessary of the alloys of the present invention that they include zinc, copper, bismuth, and selenium. For example, the alloys of the present invention may include copper, zinc, an amount of bismuth effective to enhance castability of the brass alloy, and an amount of selenium effective to increase machinability of brass alloy. Preferably, if necessary due to its application, the alloy further includes an amount of antimony effective to inhibit dezincification of the brass alloy. Other ingredients, such as tin, iron, nickel, aluminum, and magnesium preferably are added to the alloys of the present invention, as set forth below.

The alloys of the present invention preferably include antimony to inhibit dezincification of the brass alloys. Antimony preferably is present in an amount ranging from about 0.02% to about 0.04% by weight. It has been observed that this range represents the optimal amount of antimony, and that greater or lesser amounts of antimony will not be as effective in inhibiting dezincification.

To enhance the corrosion resistance of the alloys of the present invention, tin preferably is added in an amount of at least 0.2% by weight. The addition of this amount of tin also is thought to enhance the fluidity of the molten alloys, thus allowing the alloys to be more readily cast. Preferably, tin is added in a range of about 0.2% to about 0.4% by weight. At amounts greater than about 0.4% by weight, it is sometimes observed that intermetallic compounds of tin and other alloy components may form. One consequence is that the polishability of the alloy may be adversely affected when tin is added in amounts greater than about 0.4% by weight.

Preferably, the alloys of the present invention include iron to enhance the corrosion resistance of the alloys. Iron further is thought to serve to enhance the fine grain structure of the brass alloys. Preferably, iron is present in an amount ranging from about 0.1% to about 0.3% by weight. It is believed that higher amounts of iron would not be soluble in the brass matrix, and would act as a nucleating agent to precipitate other components of the alloys.

Nickel preferably is included in the alloys of the present invention. Preferably, nickel is added in an amount ranging from about 0.15% to about 0.25% by weight. Nickel is believed to inhibit the nucleating effect of iron in the brass alloys, and further is believed to enhance the corrosion resistance of the alloys. Nickel is believed to adversely affect the machinability of the alloys when added in amounts greater than about 0.25% by weight.

The alloys of the present invention preferably further include aluminum in an amount ranging from about 0.3% to about 0.6% by weight; preferably, from about 0.35% to about 0.45% by weight. Aluminum is added in such amounts to increase the surface tension of the molten brass alloys. As is well known to those skilled in the art, aluminum causes a thin film or "shield" to form on the molten surface of the alloy. This shield inhibits oxidation of the alloy, and enhances the surface appearance of the brass when cooled. It is believed that the addition of aluminum in amounts greater than about 0.6% by weight would cause the brass alloys of the present invention to become brittle, and to impair machinability of the alloys. Aluminum has the additional benefit of enhancing the fluidity of the brass when the brass cools.

The brass alloys of the present invention preferably include an amount of magnesium effective to enhance the appearance of the cast alloy. Magnesium should be added in an amount ranging from about 0.003% to about 0.01% by weight, preferably, from about 0.003% to about 0.005%. Magnesium enhances the color and uniform appearance of the alloy. The addition of magnesium in amounts greater than about 0.01% is believed to adversely affect the color and surface appearance of the alloy.

The brass alloys of the present invention preferably do not include lead. If present, lead preferably is present in an amount ranging from 0.0% to about 0.25% by weight. At amounts greater than about 0.25% by weight, it is believed that excessive amounts of lead may leach into potable water systems when the alloys of the present invention are used as plumbing components.

Silicon preferably is completely absent from the alloys of the present invention as well. It is preferred that silicon is present in the alloys of the present invention, if at all, in an amount ranging from 0.0% to about 0.01% by weight. If silicon is included in greater amounts, it is believed that it would act as a nucleating agent, causing precipitation of other components from the brass matrix. Manganese, which is believed to have a similar effect, also is preferably completely absent from the alloys of the present invention. If present, manganese preferably is present in the alloys in an amount ranging from 0.0% to about 0.01% by weight.

The alloys of the present invention further preferably exclude sulfur and phosphorus. Sulfur and phosphorus each preferably are present in an amount ranging from 0.0% to about 0.01% by weight, if indeed these elements are present at all. If used in greater amounts, it is believed that both phosphorus and sulfur may cause the alloys of the present invention to become brittle. Further, it is believed that greater amounts of sulfur may increase the level of porosity of the alloy and therefore adversely affect the pressure tightness of the alloy.

Preferably, the alloys of the present invention are grain refined, to enhance the polishability, dezincification resistance and machinability of the alloys. One or more grain refiners may be added to the alloys for this purpose. For instance, boron may be used as a grain refiner. As is known to those of ordinary skill in the art, boron may be added in any suitable form, including, for example, as elemental boron; as a boride, such as, for example, aluminum boride; or as a boron salt, such as, for example, $KBF_4$. Preferably, boron is added in an amount ranging from about 10 ppm to about 15 ppm, based upon the weight of elemental boron. When added, the boron should be added to the melt of the other components. The grain refiner need not include boron, and, indeed, any suitable grain refiner may be used in the alloys of the present invention.

To further refine the grain of the alloys of the present invention, the alloys preferably are subjected to a permanent mold chill casting process. As is known to those of ordinary skill in the art, such process comprises the steps of melting an ingot of the brass alloy, pouring the molten alloy into a permanent mold, and allowing the alloy to cool. Preferably, the alloys of the present invention are heated to a temperature of about 1040° C. to about 1050° C., then cooled quickly. It has been observed that this process causes further grain refinement of the alloys of the present invention. Preferably, the alloy is chilled quickly by pouring it into a beryllium/copper mold having a core of sand or other suitable material. As compared to a sand mold, a beryllium/copper mold draws heat rapidly from the alloy and allows the alloy to solidify directionally from the outside of the mold to its center. This process results in an alloy that has a finer grain, and hence is more polishable, than one cast in a sand mold. The alloy may be hand-cast, gravity-cast, or low-pressure cast. In certain instances, the chill casting process may produce a sufficiently fine grain structure such that the addition to the alloy of a grain refiner, such as boron, may be unnecessary.

The alloys of the present invention preferably are free or essentially free of other elements. Of course, it is prohibitively expensive to obtain highly pure allotments of any of the metals used in the alloys of the present invention on a commercial scale. Accordingly, one preferred form of the present invention contemplates an alloy that consists essentially of zinc, copper, tin, iron, nickel, aluminum, bismuth, antimony, and selenium, but that further includes trace amounts of other elements. Preferably, such other elements are present, if at all, only in trace amounts, each trace element present in an amount of not more than about 0.01% by weight.

The following examples further illustrate the present invention but, of course, should not be construed as in any way limiting its scope.

EXAMPLE 1

A brass alloy having the following composition was prepared:

| Component | Weight Percent |
|---|---|
| Copper | 63.5% |
| Tin | 0.3% |
| Iron | 0.2% |
| Nickel | 0.2% |
| Aluminum | 0.4% |
| Bismuth | 0.9% |
| Antimony | 0.03% |
| Selenium | 0.12% |
| Magnesium | 0.004% |
| Zinc | balance |

The alloy of Example 1 was essentially free of other elements, except that boron was used as a grain refiner.

This alloy was cast using a permanent mold process. The resulting lead-free cast brass alloy was non-brittle, and readily machinable, having a machinability index of about 75. This alloy further was suitably polishable, and was highly resistant to dezincification. The alloy is suitable for use in a decorative plumbing fixture.

EXAMPLE 2

A brass alloy having the following composition was prepared:

| Component | Weight Percent |
|---|---|
| Copper | 63.5% |
| Bismuth | 0.9% |
| Selenium | 0.12% |
| Zinc | balance |

The alloy of Example 2 was essentially free of other elements. Upon casting using a permanent mold process, this alloy yielded castings which were non-brittle and readily machinable.

EXAMPLE 3

The alloy of Example 2 was prepared, except that the alloy further included 0.03% antimony by weight. Upon casting using a permanent mold process, the alloy of Example 3 displayed the same non-brittle and easily machinable characteristics of the previous example, with the added benefit of being resistant to dezincification.

EXAMPLE 4

The alloy of Example 2 was prepared, except that the alloy further included 0.4% aluminum by weight. The presence of the aluminum minimized the oxidation of the zinc by forming a "skin" on the surface of the molten metal and, as a result, contributed to an improved appearance of the as-cast surface of the casting.

EXAMPLE 5

The alloy of Example 4 was prepared, except that the alloy further included, by weight, about 0.3% tin, 0.2% iron and 0.2% nickel, with the combined total of all three elements in the range of 0.65% to 0.75%. The presence of these elements in these concentrations improved the corrosion resistance of the metal, reduced the potential for polishing-related defects known as "hard-spots," and provided a chemistry which allowed the metal to respond more favorably to the grain refining addition of boron.

EXAMPLE 6

The alloy of Example 5 was prepared, except that the alloy further included about 0.005% magnesium by weight. The presence of the magnesium modified the reaction between the molten metal and the permanent mold surface to provide a more uniform appearance on the casting surface. It also enhanced the color of the casting.

As is apparent from the foregoing description of the present invention, the drawbacks inherent in previously known brasses have been overcome. The present invention provides a non-brittle, reduced-lead yellow brass that is readily machinable and that is suitable for casting in a permanent mold casting process. The alloys of the present invention may be fashioned into plumbing fixtures and other decorative brass products. Dezincification is not a significant concern with the alloys of the present invention. Further, the alloys of the present invention will not leach excessive amounts of lead into potable water, thus rendering them especially suitable for use as plumbing fixtures in potable water systems.

While particular embodiments of the invention have been shown, it will of course be understood that the invention is not limited thereto since modifications may be made by those skilled in the art, particularly in light of the foregoing teachings. For example, other elements may be added in lieu of or in addition to tin, iron, nickel, aluminum, and antimony to serve the same functions carried out by these elements in the preferred embodiments of the present invention. It is, therefore, contemplated by the appended claims to cover any such modifications as incorporate those features which constitute the essential features of these improvements within the true spirit and scope of the invention.

What is claimed is:

1. A yellow brass alloy consisting essentially of:

copper in an amount ranging from about 62.5% to about 64.0% by weight;

tin in an amount ranging from about 0.2% to about 0.4% by weight;

iron in an amount ranging from about 0.1% to about 0.3% by weight;

nickel in an amount ranging from about 0.15% to about 0.25% by weight;

aluminum in an amount ranging from about 0.3% to about 0.6% by weight;

bismuth in an amount ranging from about 0.8% to about 1.0% by weight;

antimony in an amount ranging from about 0.02% to about 0.04% by weight;

selenium in an amount ranging from about 0.05% to about 0.25% by weight; and balance zinc.

2. The brass alloy of claim 1, said alloy consisting essentially of:

copper in an amount ranging from about 63.25% to about 63.75% by weight;

tin in an amount ranging from about 0.2% to about 0.4% by weight;

iron in an amount ranging from about 0.1% to about 0.3% by weight;

nickel in an amount ranging from about 0.15% to about 0.25% by weight;

aluminum in an amount ranging from about 0.35% to about 0.45% by weight;

bismuth in an amount ranging from about 0.85% to about 0.95% by weight;

antimony in an amount ranging from about 0.02% to about 0.04% by weight; and selenium in an amount ranging from about 0.10% to about 0.15% by weight; and balance zinc.

3. The brass alloy of claim 2, wherein lead is present in an amount ranging from 0.0% to about 0.25% by weight;

wherein silicon is present in an amount ranging from 0.0% to about 0.01% by weight;

wherein manganese is present in an amount ranging from 0.0% to about 0.01% by weight;

wherein sulphur is present in an amount ranging from 0.0% to about 0.01% by weight; and wherein phosphorus is present in an amount ranging from 0.0% to about 0.01% by weight.

4. The brass alloy of claim 1, wherein said alloy is grain refined with boron, wherein said boron is present in an amount ranging from about 10 parts per million ppm to about 15 ppm elemental boron.

5. The brass alloy of claim 1, wherein said alloy further consists essentially of magnesium in an amount ranging from about 0.003% to about 0.01% by weight.

6. The alloy of claim 1, said alloy having a grain which is refined by a permanent mold chill casting process.

7. The alloy of claim 1, wherein said copper is present in an amount ranging from about 63.25% to about 63.75% by weight.

8. A yellow brass alloy casting formed by subjecting the yellow brass alloy of claim 6 to a permanent mold casting process.

9. The casting of claim 8, wherein said casting process is a chill casting process.

10. The casting of claim 8, wherein said alloy further consist essentially of antimony in an amount ranging from about 0.02% to about 0.04% by weight.

* * * * *